US006397483B1

(12) United States Patent
Perkins

(10) Patent No.: US 6,397,483 B1
(45) **Date of Patent: *Jun. 4, 2002**

(54) SIGHT APPARATUS

(76) Inventor: Ronald Keith Perkins, 2065 E. Nunneley Ct., Gilbert, AZ (US) 85296

( * ) Notice: Subject to any disclaimer, the term of this patent is extended or adjusted under 35 U.S.C. 154(b) by 0 days.

This patent is subject to a terminal disclaimer.

(21) Appl. No.: 09/716,789

(22) Filed: Nov. 20, 2000

Related U.S. Application Data

(63) Continuation of application No. 09/108,349, filed on Jul. 1, 1998, now Pat. No. 6,154,971.

(51) Int. Cl.[7] ..... F41G 1/32; F41G 1/467
(52) U.S. Cl. ..... 33/265; 124/87
(58) Field of Search ..... 33/265; 124/87

(56) References Cited

U.S. PATENT DOCUMENTS

| | | | | |
|---|---|---|---|---|
| 3,670,422 A | | 6/1972 | Stebbins et al. | |
| 4,195,414 A | | 4/1980 | Robinson | |
| 4,689,887 A | | 9/1987 | Colvin | 33/265 |
| 4,894,921 A | | 1/1990 | Barlow | |
| 5,086,567 A | | 2/1992 | Tutsch | 33/265 |
| 5,131,153 A | | 7/1992 | Seales | 33/265 |
| 5,339,227 A | | 8/1994 | Jones | |
| 5,341,791 A | | 8/1994 | Shafer | |
| 5,419,303 A | | 5/1995 | Stewart | |
| 5,435,068 A | | 7/1995 | Thames et al. | 33/265 |
| 5,464,003 A | | 11/1995 | Sherman | |
| 5,479,712 A | | 1/1996 | Hargrove et al. | |
| 5,575,072 A | | 11/1996 | Eldridge | |
| 5,634,278 A | | 6/1997 | London | |
| 6,154,971 A | * | 12/2000 | Perkins | 33/265 |

* cited by examiner

*Primary Examiner*—Christopher W. Fulton
(74) *Attorney, Agent, or Firm*—Schmeiser, Olsen & Watts

(57) ABSTRACT

A sight for use with a weapon for aiding a user to fire a projectile toward a target, the sight including a fixture carried by the weapon, a crosshair carried by the fixture and a plurality of sight elements immovably carried by the crosshair.

33 Claims, 4 Drawing Sheets

FIG. 1
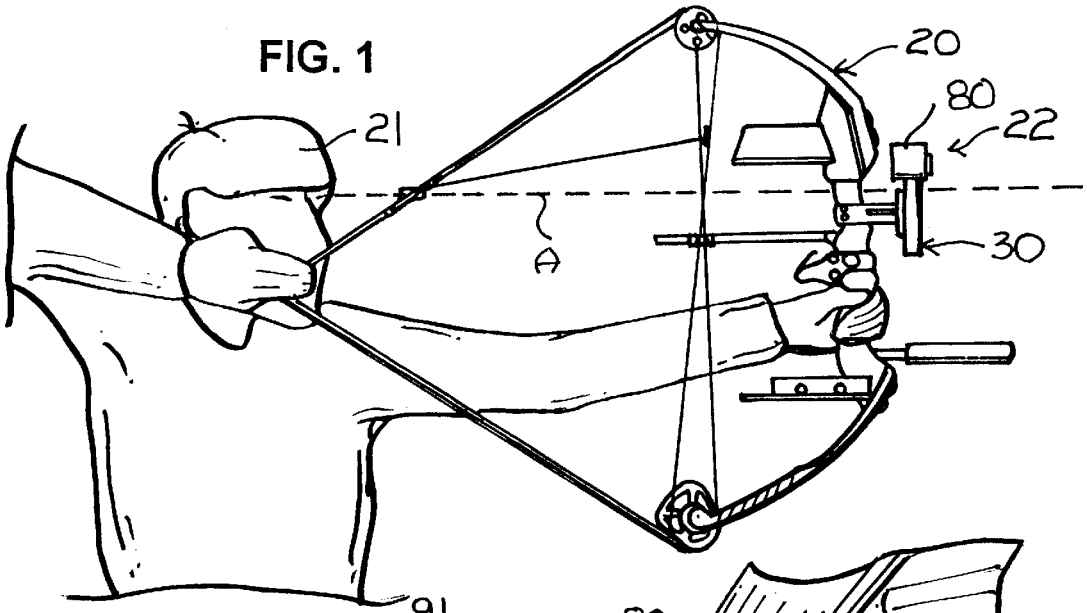
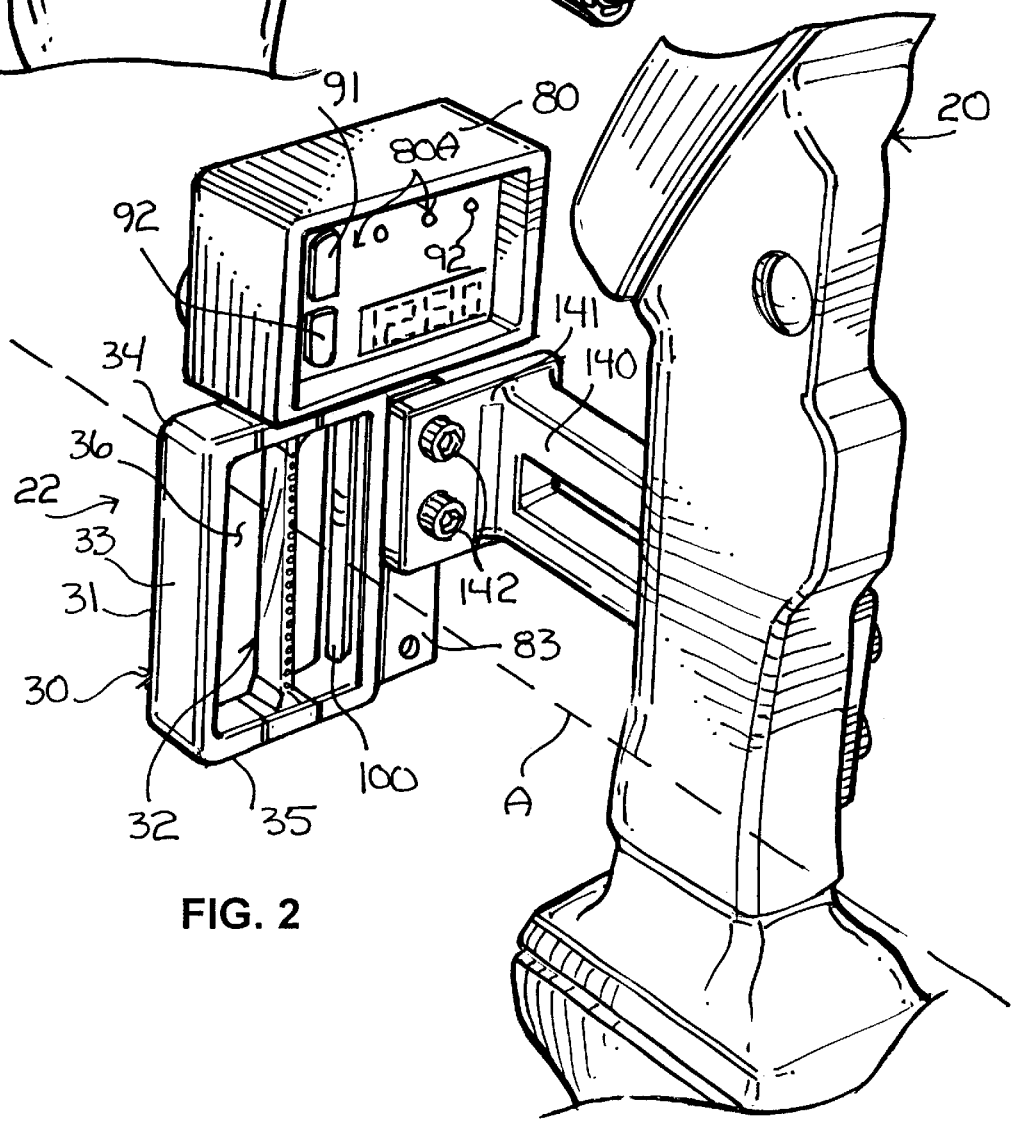
FIG. 2

91
80A
80
92
72
92
22
34
70
50
53
40
33
45
31
41
36
100
32
71
51
54
35
73
30
83
80
80A
91
92
92
22
61A
53
50
34
81
82
83
45
40
32
70
102
36
33
100
51
54
110
71
62A
73
31
35
30

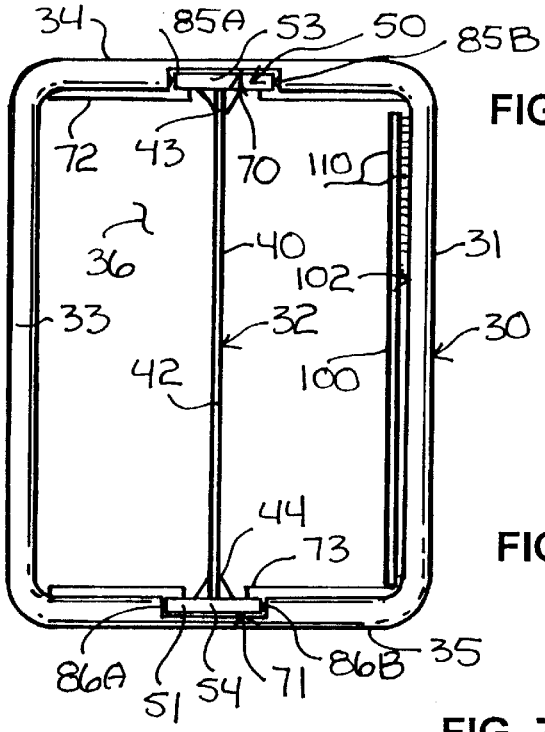
FIG. 5
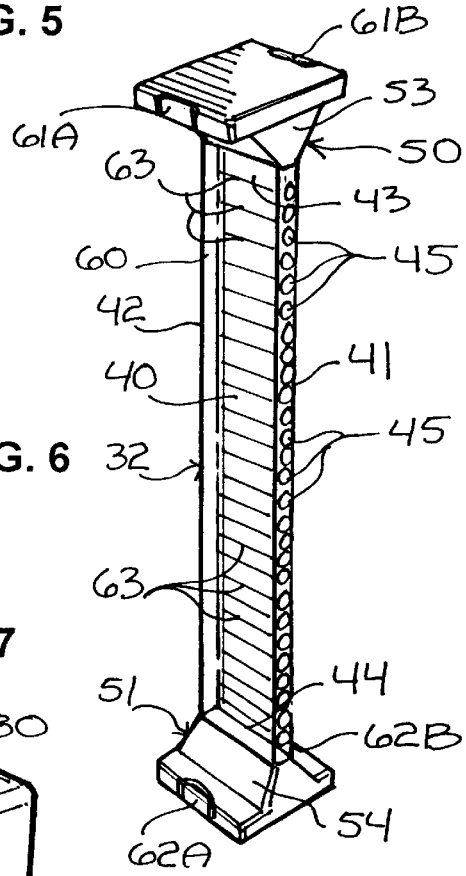
FIG. 6
FIG. 7
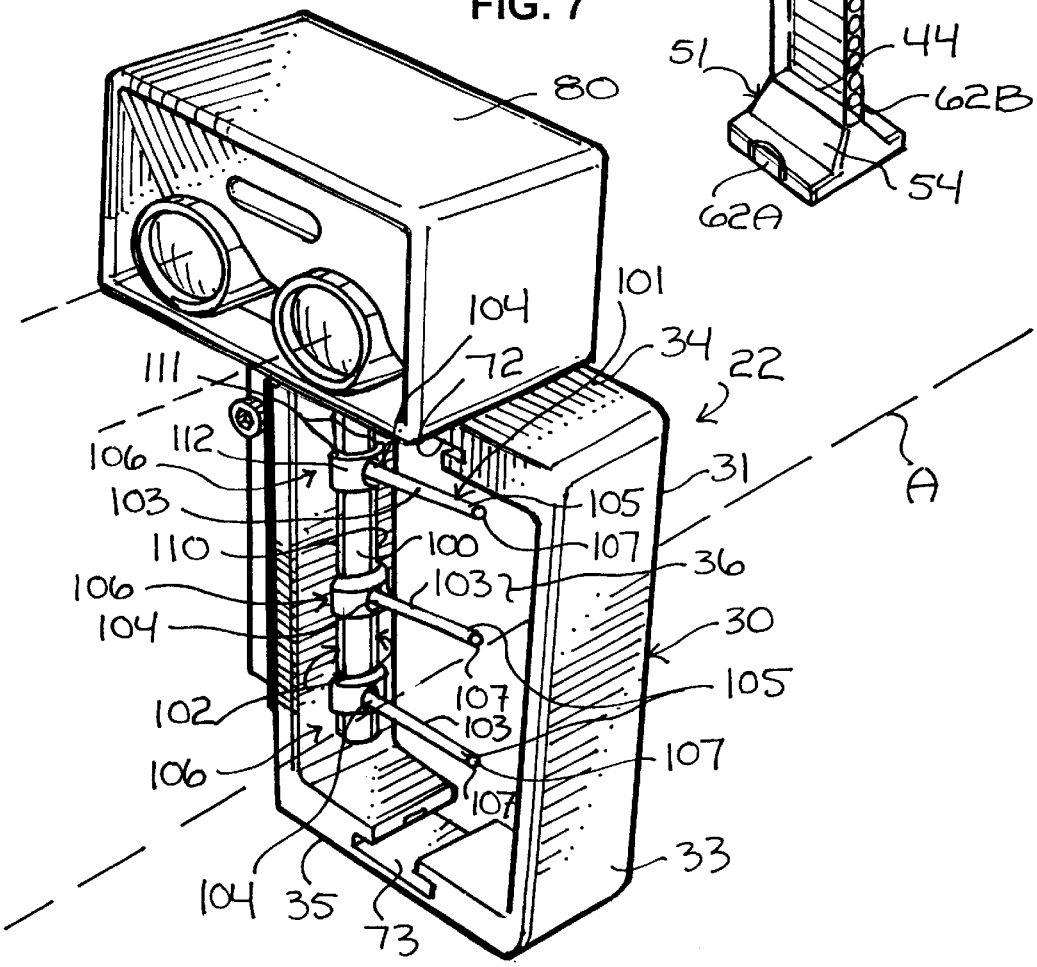

SIGHT APPARATUS

This is a continuation of application Ser. No. 09/108,349, filed Jul. 1, 1998 now U.S. Pat. No. 6,154,971.

FIELD OF THE INVENTION

This invention relates generally to the field of weapons and, more particularly, to improved sight apparatus for use with weapons such firearms and archery bows.

BACKGROUND OF THE INVENTION

Weapons, such as firearms and archery bows, are commonly used for either hunting or target shooting. In this vein, archery is generally defined as a sport involving shooting arrows with a bow, either at inanimate targets or at game. To increase shooting distance, accuracy and comfort, skilled artisans have devised apparatus that may be attached to the bow such as stabilizers, torque flight compensators, counterweight rods and, for instance, lens-less bow sights.

Throughout much of the last decade, considerable attention has been directed toward increasing the efficiency and functionality of not only bow sights, but also sights used with firearms such as rifles, shotguns and handguns. To this end, skilled practitioners in the art have devised sights having fiber optics, light emitting elements, reflective lenses and, for instance, range finding apparatus. Although exemplary, these and other known sights significantly obstruct the user's field of view toward proposed targets which often contributes to inaccurate aiming.

It would be highly advantageous, therefore, to remedy the foregoing and other deficiencies inherent in the prior art.

Accordingly, it would be highly desirable to provide new and improved sight apparatus for use with an archery bow or firearm for aiding a user to fire a projectile, such as an arrow or bullet, toward a target.

It is a purpose of the present invention to provide new and improved sight apparatus that is easy to use.

It is another purpose of the present invention to provide new and improved sight apparatus that maximizes a user's field of view toward a desired target.

It is still another purpose of the present invention to provide new and improved sight apparatus that is easy to construct.

It is a further purpose of the present invention to provide new and improved sight apparatus that is inexpensive.

It is yet a further purpose of the present invention is to provide new and improved sight apparatus that is highly efficient.

It is still a further purpose of the present invention to provide new and improved sight apparatus that is highly durable and resistant to damage during normal use.

It is another purpose of the present invention to provide new and improved sight apparatus that provides automatic range and trajectory finding capabilities.

It is yet another purpose of the present invention to provide new and improved sight apparatus that provides automatic aiming capability.

It is still another provision of the present invention to enhance aiming accuracy.

SUMMARY OF THE INVENTION

The above problems and others are at least partially solved and the above purposes and others are realized in a sight for use with an archery bow for aiding an archer to fire an arrow toward a target. In a particular embodiment, the sight of the present invention may comprise a fixture carried by the bow, a crosshair carried by the fixture and having ends, and a plurality of sight elements immovably carried by the crosshair between the ends preferably in it substantially abutting relation. Although crosshair may be fixedly coupled with the fixture, crosshair is preferably detachably carried by the fixture to facilitate replacement as needed.

To this end, the present invention may further include an engagement assembly carried by the crosshair and a detachably engagable complemental engagement assembly carried by the fixture. In a particular embodiment, the engagement assembly may include a first T-body and a second T-body each carried proximate one of the ends of the crosshair. In this regard, the complemental engagement assembly may include first and second T-slots carried by the fixture and each for detachably receiving one of the first T-body and the second T-body of the engagement assembly.

Each of the plurality of sight elements may comprise a light emitting element. A power source carried by one of the fixture and the bow may also be provided and coupled with each of the light emitting elements for facilitating illumination of one or more of the light emitting elements as desired during normal use.

In another embodiment, the present invention may further include a carriage carried by the fixture and at least one sight pin engagable with the carriage. To detachably engage the sight pin with the carriage, the present invention may further include an engagement assembly carried by the carriage, and a detachably engagable complemental engagement assembly carried by the sight pin. In a specific embodiment, the engagement assembly carried by the carriage may comprise a detent engagement assembly, and the detachably engagable complemental engagement assembly carried by the sight pin may comprise a complemental detent engagement assembly.

In yet another embodiment, the present invention may still further include a sight pin assembly engagable with the fixture, the sight pin assembly including a carrier element and at least one sight pin carried by the carrier element. To engage the sight pin assembly with the fixture, the present invention may further include an engagement assembly carried by the sight pin assembly, and a detachably engagable complemental engagement assembly carried by the fixture. In a specific embodiment, the engagement assembly of the sight pin assembly may comprise includes a first T-body and a second T-body carried by the sight pin assembly, and the complemental engagement assembly of the fixture may comprise the first and second T-slots carried by the fixture and each for detachably receiving one of the first T-body and the second T-body of the sight pin assembly.

It accordance with yet still another exemplary embodiment, the present invention may still further include a range finder carried by the bow for estimating a range of a target spaced from the bow, and a controller responsive to the range finder for illuminating a selected one of the light emitting elements to correspond with the range.

Although the foregoing embodiments have been disclosed for use in combination with an archery bow, one or more of the foregoing embodiments may be used with a crossbow or a firearm such a handgun, rifle, shotgun, etc.

BRIEF DESCRIPTION OF THE DRAWINGS

The foregoing and further and more specific objects and advantages of the instant invention will become readily apparent to those skilled in the art from the following detailed description thereof taken in conjunction with the drawings in which:

FIG. 1 is a side elevational view of an archery bow as it would appear in use by an archer, the archery bow including sight apparatus for aiding the archer to fire an arrow toward a target, in accordance with the present invention;

FIG. 2 is an enlarged perspective view of the sight apparatus of FIG. 1 shown as it would appear carried by the archery bow, the sight apparatus comprising a range finder and a sight assembly having a crosshair carried by a fixture;

FIG. 5 is a rear elevational view of the sight assembly of FIG. 2;

FIG. 6 is an enlarged perspective view of the crosshair of the sight assembly of FIG. 2;

FIG. 7 is a perspective view of sight apparatus of FIG. 2, the sight assembly shown as it would appear having a plurality of sight pins carried by a carriage supported by the fixture;

DETAILED DESCRIPTION OF A PREFERRED EMBODIMENT

Figures 3, 4:
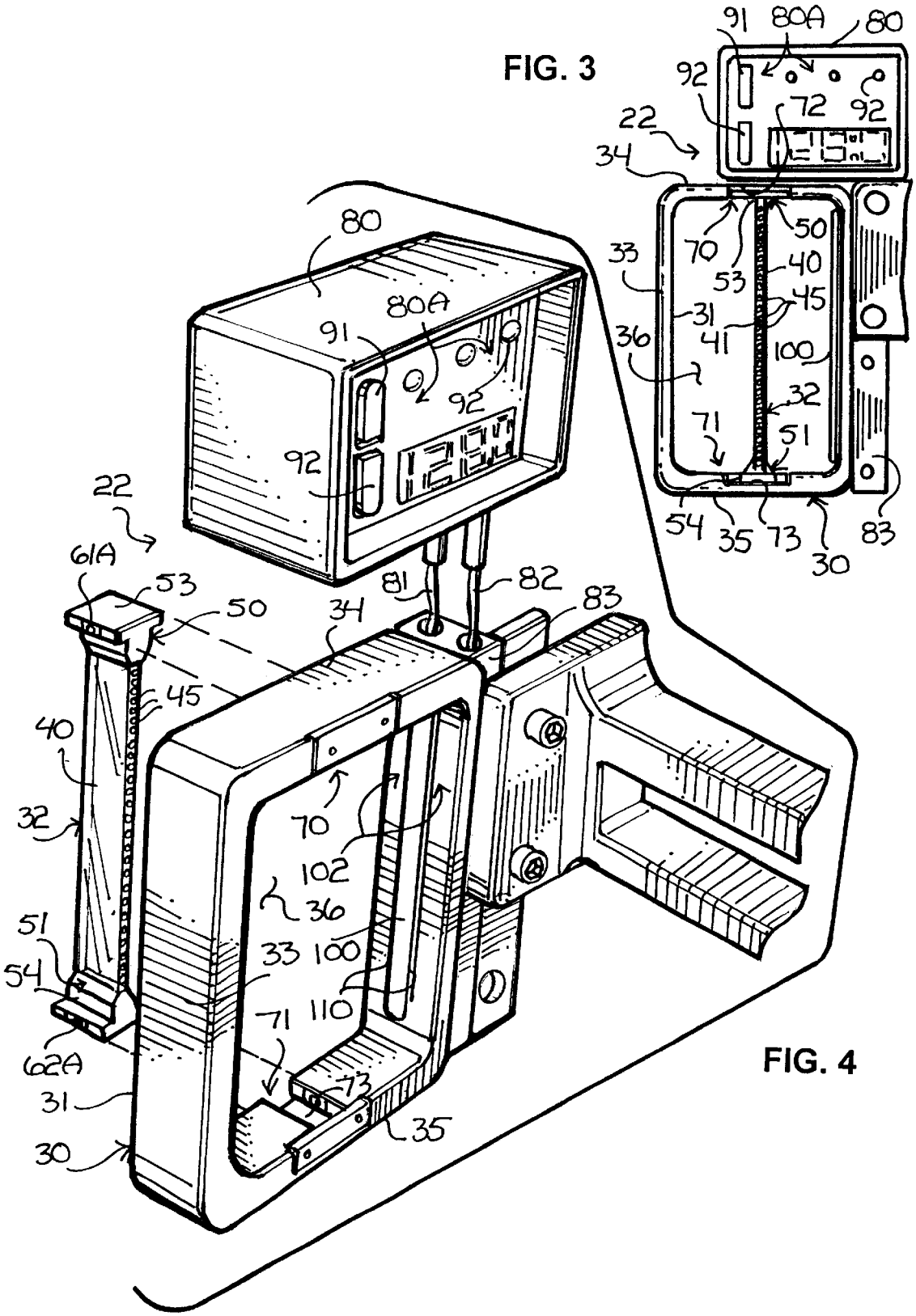
FIG. 3 is a front elevational view of the sight apparatus of FIG. 2.
FIG. 4 is a partially exploded perspective view of the sight apparatus of FIG. 2.

The present invention provides, among other things, improved sight apparatus for use with an archery bow for aiding an archer to fire an arrow toward a target. The present invention is exemplary not only for providing highly accurate aiming, but also for maximizing the archer's field of view toward proposed targets.

Turning now to the drawings, in which like reference characters indicate corresponding elements throughout the several views, attention is first directed to FIG. 1 illustrating a side elevational view of an archery bow 20 as it would appear in use by an archer 21. Carried or otherwise supported by archery bow 20 is sight apparatus 22 positioned in the archer's field of view as generally defined by sight line A, sight apparatus 22 for aiding archer 21 to fire an arrow toward a target along sight line A, in accordance with the present invention.

Referring to FIGS. 2–4, sight apparatus 22 comprises a sight or sight assembly 30 including a fixture 31 and a crosshair 32. In this specific example, fixture 31 is generally comprised of a continuous sidewall 33 that bounds an opening 36. For the purposes of orientation, continuous sidewall 33 is generally intended to include an upper end 34 and a lower end 35. In accordance with the present invention, fixture 31 of sight assembly 30 may be mounted or otherwise carried by archery bow 20 and selectively positioned to permit the sight line A to pass through opening 36 as best shown in FIG. 2. In this vein, fixture 31 operates as a supporting framework for supporting crosshair 32 in substantially vertical alignment in opening 36 and, more particularly, at sight line A, crosshair 32 being available to archer 21 at sight line A for aiding archer 21 to aim and shoot an arrow toward a proposed target. Although crosshair 32 may be fixedly carried by fixture 31, it is preferred that crosshair 32 be removably or otherwise detachably engagable with fixture 31 to facilitate removal and replacement if needed.

Turning now to FIG. 6, crosshair 32 is generally comprised of a thin elongate body 40 constructed of, for instance, molded plastic, polypropylene or the like. Elongate body 40, includes a front end 41, a rear end 42 and opposing first and second ends 43 and 44. Immovably carried or otherwise captured by elongate body 40 at front end 41 between first and second ends 43 and 44 is a plurality of sight elements 45. In a preferred embodiment, sight elements 45 extend in series substantially from first end 43 to second end 44 in substantially abutting relation. Sight elements 45 may each comprise a protuberance or beaded projection, an aperture, a notch, or, in accordance with the present embodiment, a discrete light emitting element such as a light-emitting diode or the like, each of which may be illuminated upon energizing with electrical energy, further details of which will be discussed shortly.

As evinced in FIG. 6, first and second ends 43 and 44 each carry first and second engagement elements 50 and 51 each cooperating together to define an engagement assembly of the crosshair 32. In this specific example, first and second engagement elements 50 and 51 each comprise a T-body 53 and 54, respectively. Each T-body 53 and 54 is preferably constructed of molded plastic, polypropylene, or the like, and may be fixed with one of first and second ends 43 and 44 of elongate body 40 via a selected and suitable adhesive, integral molding, etc.

To conduct electrical energy to each one of the plurality of sight elements 45 from a power source for illumination, crosshair 32 carries a conductive spine 60 that runs along the length of elongate body 40 from first end 43 to second end 44 at, in this specific example, rear end 42. Conductive spine 60 is further coupled in electrically conductive relation with opposing contacts 61A and 61A carried by T-body 53 of first engagement element 50, with opposing contacts 62A and 62B carried by T-body 54 of second engagement element 51, and with each one of sight elements 45 via a plurality of discrete electrical interconnections 63 carried by elongate body 40. Because elongate body 40 is preferably constructed of molded plastic, polypropylene or the like, sight elements 45, conductive spine 60 and electrical interconnections 63 may be molded into elongate body 40 if so desired for ease of manufacture.

To mount crosshair 32 with fixture 31, and with reference to FIG. 5 illustrating a rear elevational view of sight assembly 30, continuous sidewall 33 may include first and second complemental engagement elements 70 and 71 each cooperating together to define a complemental engagement assembly of fixture 31, first and second complemental engagement elements 70 and 71 being carried by continuous sidewall in substantially opposing relation at upper and lower ends 34 and 35, respectively. In this specific example, first and second complemental engagement elements 70 and 71 each comprise a T-slot 72 and 73 each for removably or otherwise detachably receiving one of T-body 53 and T-body 54 as shown for supporting crosshair 32 in substantially vertical alignment at opening 36 as also seen in FIG. 3 illustrating a front elevational view of sight assembly 30 shown as it would appear to an archer during use with sight elements 45 facing the archer.

Although T-bodies 53 and 54 and T-slots 72 and 73 have been disclosed as exemplary for facilitating the detachably engagement of crosshair 32 with fixture 31, those having regard toward the relevant art will appreciate that other conventional and known engagement assemblages may be used to facilitate the detachable engagement of crosshair 32 with fixture 31 without departing from the teachings herein set forth. In this regard, the engagement assembly and complemental engagement assembly of crosshair 32 and fixture 31, respectively, may include threaded and detachably engagable complemental threaded engagement assemblies, snap and detachably engagable complemental snap engagement assemblies, magnetic and detachably engagable complemental magnetic engagement assemblies, etc.

With attention directed to FIG. 3, the thin profile of crosshair 32 minimally obstructs, or otherwise maximizes, the archer's field of view toward a desired target as viewed by the archer along sight line A (not shown in FIG. 3). With sight elements 45 facing the archer, sight elements 45 may be employed by the archer for aligning or otherwise orienting archery bow 20 at a desired angle relative a selected target prior to release of an arrow. Because sight elements 45 are small, may be illuminated and extend substantially from first engagement element 50 to second engagement element 51 in series and preferably in substantially abutting relation, they are easy to see and provide an archer with a highly accurate range of aiming trajectories each defined by one of sight elements 45. In this regard, each sight element 45 functions as a device for guiding the archer's sight line toward a projected target and by which the projected target's direction and distance may be settled or ascertained prior to shooting an arrow.

It will be readily understood that in order to illuminate each of sight elements 45, it is necessary to provide crosshair 32 with electrical energy provided from an electrical power source such as a solar operated power source, a conventional battery or other self-contained power source that may be attached to or otherwise carried at least by one of archery bow 20 and fixture 31 and coupled with crosshair 32 in electrical communication. To this end, and with attention directed to FIGS. 2–4, the present invention may be provided with a conventional range finder 80 containing a power source. As shown in FIGS. 2 and 3, range finder 80 may be mounted to continuous sidewall 33 of sight assembly 30 if desired such as with a selected adhesive, one or more screws or other conventional fastening mechanism. Range finder 80 may also be mounted or otherwise carried by archery bow 20 at one or more other locations along fixture 31 and archery bow 20 without departing from the invention.

Regarding FIG. 4, the power source contained by range finder 80 may be coupled in electrical communication with contacts 61A, 61B, 62A and 62B of crosshair 32 via electrical interconnections 81 and 82 for permitting electrical energy to conduct from one or more of contacts 61A, 61B, 62A and 62B to conductive spine 60 and into and through one or more of electrical interconnections 63 to illuminate one or more of sight elements 45 upon, for instance, actuation of range finder 80 via one or more of controls 80A. In the specific embodiment set forth in FIG. 4, electrical interconnections 81 and 82 extend from range finder 80 and pass into an extension 83 carried along one side of continuous sidewall 33. From extension 83, electrical interconnections 81 and 82 pass into and through continuous sidewall 33 each terminating, as shown in FIG. 5, with one or more of contacts 85A and 85B positioned at T-slot 72 and contacts 86A and 86B positioned at T-slot 73. As shown in FIG. 5, contacts 85A and 85B and contacts 86A and 86B oppose one another, respectively. Furthermore, contacts 85A and 85B and contacts 86A and 86B are each suitably positioned to engage one of contacts 61A and 61B of T-body 53 and one of contacts 62A and 62B of T-body 54, respectively, upon receipt of T-bodies 53 and 54 into a corresponding one of T-slots 72 and 73.

During use, and depending upon the needs of the archer, it may be desirable for an archer to illuminate all of sight elements 45 at the same time, or to illuminate a selected one of sight elements 45. In this regard, controls 80A may include a first control button 91 (FIGS. 2–4) that an archer may depress for providing illumination of all of sight elements 45. As an alternative, controls 80A may also include a second control button 92 than an archer may depress as needed for allowing a user to scroll through sight elements as desired to select and illuminate a selected one of sight elements 45 in accordance with desired aiming needs.

In accordance with the present invention, range finder 80 may contain a trajectory finder microprocessor or controller for illuminating a selected one of sight elements 45 in response to a range of a proposed target spaced from archery bow 20 as found by range finder 80 in, for instance, an automatic run mode of range finder 80. In this regard, controls 80A may further include a third control button 92 (FIGS. 2–4) that a user may depress for placing range finder 80 into the automatic run mode. In the automatic run mode of range finder 80, the trajectory finder microprocessor or controller operates estimate an arrow trajectory path and illuminate a selected sight element 45 in accordance with the estimated arrow trajectory path in response to a projected target's range from archery bow 20 as determined by range finder 80 that a user may so align with the projected target prior to shooting an arrow. To this end, the trajectory finder microprocessor or controller may be provided with a trajectory prediction algorithm for determining an estimated arrow trajectory path in response to a target range. Although various potential trajectory prediction algorithms may be used, a specific embodiment of an exemplary trajectory prediction algorithm may include:

$$y(t)=y_o+v_o\sin\phi_o t+\tfrac{1}{2}[(CA\delta v^2/2m)(\sin\phi_o(t)-g]t^2, \text{ and}$$

$$x(t)=v_o\cos\phi_o t-\tfrac{1}{2}[(CA\delta v^2/2m)(\cos\phi_o(t)]t^2,$$

wherein, $v_0$=initial velocity of arrow projectile $y_o$=height of arrow projectile released from archery bow $\phi_o$=angle of arrow projectile flight x(t)=distance of travel of arrow projectile along an x-axis y(t)=distance of travel of arrow projectile along a y-axis g=gravity (9.8 m/sec$^2$)

c=drag coefficient (experimentally determined)

A=cross-sectional area of arrow projectile

δ=density of air v=instantaneous velocity of arrow projectile

Because the engagement assembly carried by crosshair 32 and the complemental engagement assembly carried by fixture 31 prove exemplary for facilitating the detachably engagement of crosshair 32 with fixture 31, crosshair 32 may be easily removed and replaced with a new crosshair as needed in the event of damage or breakage that may occur during normal use. As an alternative to replacing a damaged or broken crosshair 32 with a new one, such as if the archer does not have a replacement crosshair, sight assembly 30 may further include a carriage 100 (FIGS. 2–5 and 7) carried by, supported by or otherwise fixed to continuous sidewall 33 and to which one or more sight pins 101 (shown only in FIG. 7) may be attached. As best seen in FIGS. 4 and 5, carriage 100 is elongate, extends outwardly toward opening 36, extends substantially from upper end 34 to lower end 35 and carries an engagement assembly 102.

With specific attention directed to FIG. 7, each sight pin 101 is generally comprised of an elongate element 103 having a proximal end 104, a distal end 105, a complemental engagement assembly 106 carried by or otherwise proximate proximal end 104, and a sight element 107 carried by or otherwise proximate distal end 105. Complemental engagement assembly 106 carried by each sight pin 101 is detachably engagable with engagement assembly 102 of carriage 100 permitting an archer to mount one or more of sight pins 101 with carriage 100 for suspending one or more sight elements 107 in opening 36 at sight line A, one or more of which an archer may arrange and employ as desired for aiming toward a projected target. Each sight element 107 may be provided as a fiber optic element, a beaded enlargement, etc.

Regarding a specific embodiment, engagement assembly 102 of carriage 100 may comprise a detent engagement assembly 110. In this regard, complemental engagement assembly 106 of each sight pin 101 may correspondingly comprise a detachably engagable complemental detent engagement assembly 111 carried by a gripping element 112 mounted to or otherwise carried by or proximate proximal end 104, gripping element 112 operative for gripping engagement with carriage 100 for detachably engaging complemental detent engagement assembly 111 with detent engagement assembly 110. Those skilled in the art will appreciate that that other engagement mechanisms for detachably engaging one or more of sight pins 101 with carriage 100 or directly with continuous sidewall 33 may be employed if so desired such as, for instance, threaded and complemental threaded engagement elements, etc.

Figure 8:
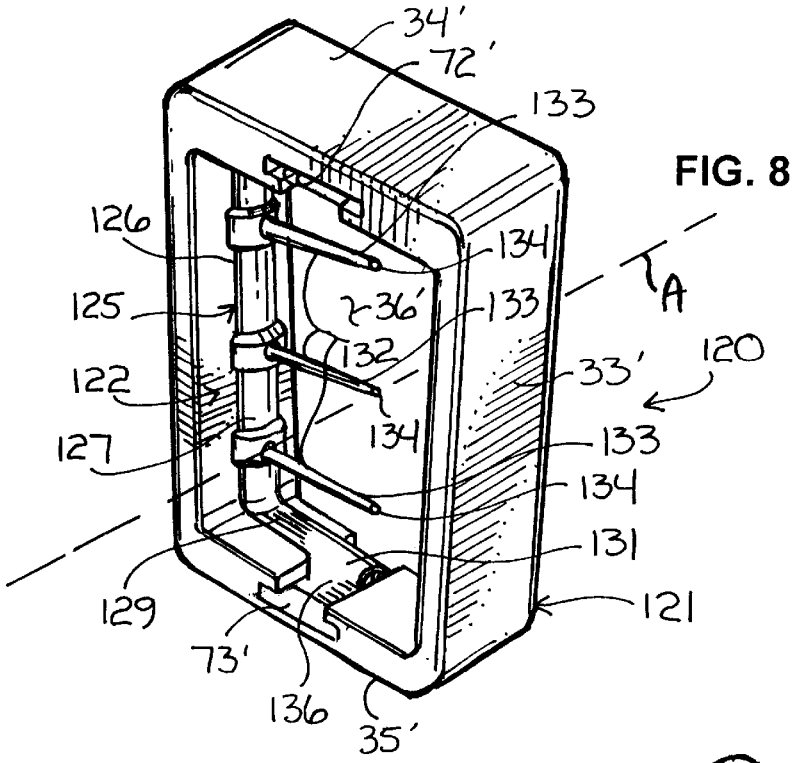
FIG. 8 is a perspective view of another embodiment of a sight assembly for aiding the archer to fire an arrow toward a target, the sight assembly comprising a fixture for receiving and supporting one of a sight pin assembly as shown and the crosshair of FIG. 6, in accordance with the present invention.

Turning now to FIG. 8, illustrated is a perspective view of another embodiment of a sight assembly 120 for aiding the archer to fire an arrow toward a target, sight assembly 120 comprising a fixture 121 for receiving one of a sight pin assembly 122 as shown and crosshair 32 discussed in combination with FIGS. 1–7. Fixture 121 is substantially similar to fixture 31 previously discussed and may be carried by archery bow 20 at sight line A in much the same fashion as fixture 31. Accordingly, common reference characters used to describe fixture 31 will also be used to describe fixture 121 to the extent of the structural similarities. However, such common reference characters used to describe fixture 121 will include a prime ("') symbol for the purposes of clarity.

Figure 9:
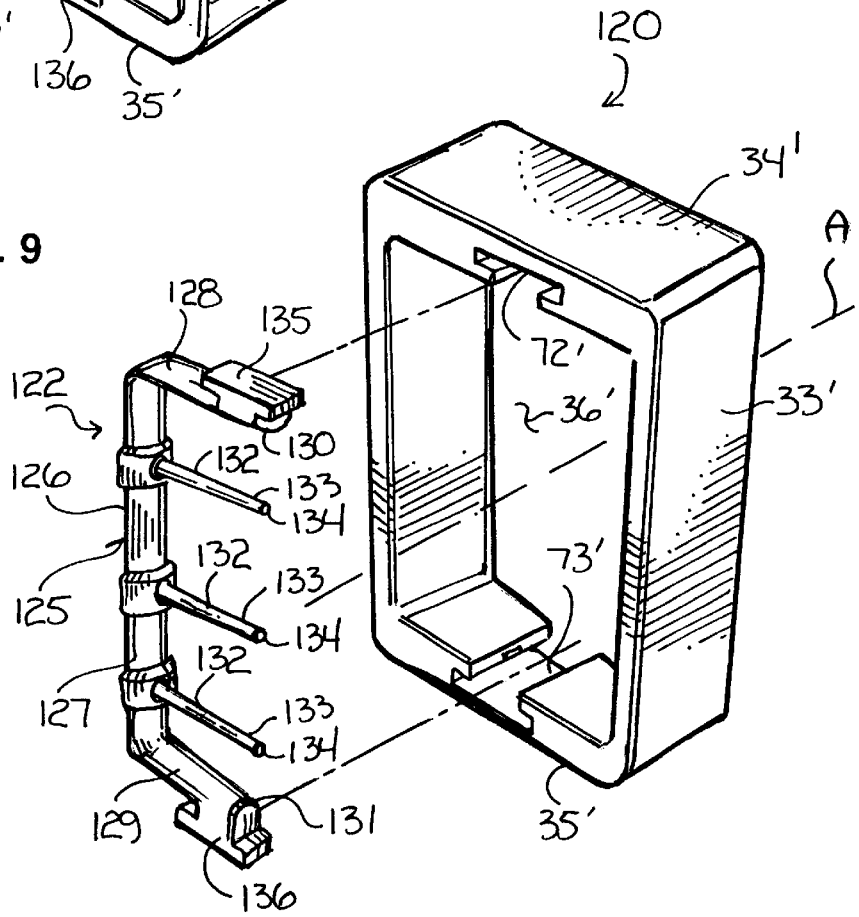
FIG. 9 is a perspective view of the sight assembly of FIG. 8 with the sight pin assembly shown detached from the fixture.

With additional reference to FIG. 9 in this regard, and like fixture 31, fixture 121 includes continuous sidewall 33', upper end 34', lower end 35', opening 36' and T-slots 72' and 73' each for detachably receiving one of T-bodies 53 and 54 of crosshair 32 in accordance with the preceding discussion. Shown as a replacement sight for detachable engagement in T-slots 72' and 73' is sight pin assembly 122. In this embodiment, sight pin assembly 122 is generally comprised of a carrier 125 including a substantially C-shaped body 126 having a back 127 interconnecting spaced-apart substantially opposing first and second extensions 128 and 129 each terminating with a free end 130 and 131, respectively. Sight pin assembly 122 further includes a plurality of sight pins 132 each carried, either removably or fixedly, by back 127 intermediate first and second extensions 128 and 129 and extending outwardly therefrom terminating with a free end 133. Each free end 133 carries a sight element 134 which may comprise a beaded protuberance, an aperture, a fiber optic element, etc. As best shown in FIG. 8, free ends 130 and 131 each carry an outwardly extending T-body 135 and 136.

As an alternative to replacing a damaged or broken crosshair 32 with a new one, such as if the archer does not have a replacement crosshair, an archer may detachably install sight pin assembly 122 with fixture 121 by inserting T-body 135 and T-body 136 into one of T-slots 72' and 73' as substantially shown in FIG. 8 to suspend sight element 134 of each sight pin 132 in opening 36' at sight line A. So installed, an archer may then employ one or more of sight elements 134 as desired for aiming toward a projected target.

Those having regard toward the art will readily appreciate that sights of varying construction may be provided and adapted for detachably engaging receipt in T-slots 72' and 73' for guiding a user's aim toward a target in lieu of crosshair 32. In addition, fixture 31 and fixture 121 may, if desired, be provided with an auxiliary engagement mechanism for detachably engaging, for instance, one of sight pin assembly 122 and at least one of a variety of potential other sights as desired for use alone or in combination with crosshair 32.

In summary, the present invention provides various embodiments of improved sight apparatus for use with an archery bow for aiding an archer to fire an arrow toward a target. Crosshair 32 of the present invention not only provides highly accurate aiming, but operates to maximize the archer's field of view toward proposed targets. Furthermore, fixtures 31 and 121 of the present invention provide an archer with replacement sight mechanisms that may be used in lieu of crosshair 32 should crosshair become damaged or otherwise inoperable. Furthermore, although sight apparatus 22 may be mounted with archery bow 20 at sight line A in a variety of suitable ways consistent with normal use, FIG. 2 illustrates an elongate supporting element 140 carried by and extending outwardly from archery bow 20 terminating with a free end 141 coupled with extension 83 via, for instance, threaded fasteners 142, elongate supporting element 140 being operative for supporting sight apparatus 22 properly at sight line A.

Those having regard toward the relevant are will understand that one or more of the foregoing embodiments of the present invention may be used not only with an archery bow, but also with other weapons such as a crossbow or a firearm such a handgun, rifle, shotgun or the like for shooting bullets or other forms of projectiles. To this end, crosshair 32 may be mounted with a firearm to increase aiming accuracy, or, for instance, incorporated into a conventional scope commonly used in combination with rifles and handguns. In addition, the range finding and trajectory finding capabilities of the present invention may also be adapted for use with firearms in combination with crosshair 32 if so desired.

The present invention has been described above with reference to a preferred embodiment. However, those skilled in the art will recognize that changes and modifications may be made in the described embodiments without departing from the nature and scope of the --present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. A bow sight comprising:

a frame containing a thin vertical member to minimally obstruct an archer's field of view toward a desired target as viewed by said archer along a sight line from the archer through the frame and to a target;

said thin vertical member having a plurality of discrete light emitting sight elements each comprising a discrete light source at or near the element, the thin vertical member defining an unobstructed field of vision on either side of the vertical member.

2. The bow sight of claim 1 wherein the frame comprises a continuous sidewall that bounds an interior area.

3. The bow sight of claim 1 wherein the frame defines an interior area through which the line of sight passes, wherein said thin vertical member divides the interior area of said frame into two unobstructed fields of view.

4. The bow sight of claim 1 wherein said thin vertical member is a cross-hair vertically aligned within the frame at the sight line.

5. The bow sight of claim 4 wherein said cross-hair is a thin elongate body having a front end, a rear end and opposing first and second ends.

6. The bow sight of claim 5 wherein the cross-hair is attached to the frame at first end and second end.

7. The bow sight of claim 5 wherein said cross-hair comprises said plurality of sight elements immovably carried by the cross-hair.

8. The bow sight of claim 7 wherein the plurality of sight elements extend in series substantially from first end of cross-hair to second end of cross-hair in substantially abutting relation.

9. The bow sight of claim 5 wherein said cross-hair carries a conductive spine.

10. The bow sight of claim 9 wherein said conductive spine runs along the length of the cross-hair from first end to second end.

11. The bow sight of claim 1 wherein said plurality of elements comprises a discrete light emitting diode.

12. The bow sight as in claim 1 further comprising a power source.

13. The bow sight as in claim 12 wherein the plurality of light emitting sight elements is a light emitting diode located along a sight side of the thin vertical member.

14. The bow sight as in claim 13 wherein said thin vertical member is structured and arranged to contain an electrical connection between the power source and the light emitting diode.

15. The bow sight as in claim 1 wherein said plurality of discrete light emitting sight elements is a fiberoptic light located along a sight side of the thin vertical member.

16. The bow sight as in claim 15 wherein said thin vertical member is structured and arranged to contain at least one fiberoptic fiber.

17. The bow sight as in claim 1 wherein the thin vertical member detachably engages the frame.

18. A bow sight comprising:

a frame containing a thin vertical member which has a thin profile to minimally obstruct an archer's field of view toward a desired target as viewed by said archer along a sight line from the archer to a target;

said vertical member comprising a plurality of discrete light emitting sight elements each associated a discrete its own discrete light source at or near the bow sight, the thin vertical member defining an unobstructed field of vision on either side of the vertical member.

19. A bow sight as in claim 18 wherein the thin vertical member is detachable from the frame.

20. The bow sight as in claim 18, wherein the thin vertical member is made of molded plastic wherein said molded plastic is structured and arranged to contain at least a portion of the plurality of discrete light emitting sight elements.

21. The bow sight as in claim 20 further comprising a detachable sight pin assembly.

22. A bow sight comprising a thin vertical member extending between an upper and a lower arm of a frame, the thin vertical member including said plurality of light emitting sight elements each configured to emit light generated by a light source at or near the bow sight.

23. The bow sight as in claim 22, wherein the thin vertical member is contained within the frame.

24. The bow sight as in claim 22, wherein the light emitting sight elements comprise at least one LED.

25. The bow sight of claim 22, wherein the light emitting sight elements comprise at least one fiberoptic fiber.

26. The bow sight of claim 22, wherein the plurality of light emitting sight elements comprise at least a first sight element and a second sight element, wherein the first sight element may be selectively caused to emit light independent of the second sight element.

27. The bow sight of claim 22, wherein the thin vertical member is detachably coupled to the frame.

28. A bow sight comprising a plurality of light emitting sight elements extending vertically from a frame within a common, thin vertical plane for assisting an archer to orient a bow relative to a projected target by visual reference with at least one of the plurality of light emitting sight elements, wherein each of the plurality of light emitting sight elements is associated with its own distinct light source.

29. The bow sight of claim 28, wherein the thin vertical plane is contained within the frame.

30. The bow sight of claim 29, wherein the light emitting sight elements comprise at least one LED.

31. The bow sight of claim 29, wherein the light emitting sight elements comprise at least one fiberoptic fiber.

32. The bow sight of claim 29, wherein the plurality of light emitting sight elements comprise at least a first sight element and a second sight element, wherein the first sight element may be selectively caused to emit light independent of the second sight element.

33. The bow sight of claim 28, wherein each of the plurality of light emitting sight elements is a fiberoptic fiber.

* * * * *

UNITED STATES PATENT AND TRADEMARK OFFICE

CERTIFICATE OF CORRECTION

PATENT NO. : 6,397,483 B1
DATED : June 4, 2002
INVENTOR(S) : Perkins

It is certified that error appears in the above-identified patent and that said Letters Patent is hereby corrected as shown below:

Column 10,
Line 4, "...associated a discrete its own discrete light…" should read as follows
-- ...associated with its own discrete light… --

Signed and Sealed this

Tenth Day of September, 2002

*Attest:*

*Attesting Officer*

JAMES E. ROGAN
*Director of the United States Patent and Trademark Office*